US006489563B1

(12) United States Patent
Zhao et al.

(10) Patent No.: US 6,489,563 B1
(45) Date of Patent: Dec. 3, 2002

(54) ELECTRICAL CABLE WITH GROUNDING SLEEVE

(75) Inventors: Jim Zhao, Mission Viejo, CA (US); Frank Quach, Irvine, CA (US); Yuan Chieh Lin, Lake Forest, CA (US); Pei Tsao, Katella, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/970,417

(22) Filed: Oct. 2, 2001

(51) Int. Cl.[7] ..... H01R 9/05
(52) U.S. Cl. ..... 174/88 C; 439/497
(58) Field of Search ..... 174/78, 117 F, 174/88 C, 88 R, 75 C; 439/497, 579, 98, 610

(56) References Cited

U.S. PATENT DOCUMENTS 5,964,620 A * 10/1999 Takahashi et al. ..... 439/579
6,031,185 A * 2/2000 Bouveret et al. ..... 174/84 R
6,273,753 B1 * 8/2001 Ko ..... 439/497

* cited by examiner

*Primary Examiner*—Chau N. Nguyen
(74) *Attorney, Agent, or Firm*—Wei Te Chung

(57) ABSTRACT

An electrical cable (1) adapted for terminating with an electrical connector (2) includes a pair of cable subassemblies (10). Each cable subassembly has two signal wires (101) and a metal braid (102) wraps round the two signal wires. Each signal wire includes a signal conductor (103) and an insulating layer (104) outside. An outer jacket (12) surrounds the two cable subassemblies. A grounding sleeve (11) includes two recess portions (110) for receiving exposed front portions of the respective cable subassemblies press-fitted therein. Three grounding pins (113) project from the grounding sleeve at intervals for being soldered to corresponding grounding terminals (21, 22, 23) of the electrical connector.

8 Claims, 4 Drawing Sheets

ELECTRICAL CABLE WITH GROUNDING SLEEVE

BACKGROUND OF THE INVENTION

1. Field of the Invention

The present invention relates to an electrical cable, and particularly to an electrical cable having an improved grounding means.

2. Description of Prior Art

Referring to FIG. 5, a conventional electrical cable 40 adapted for transmitting signals comprises a pair of cable subassemblies 41. Each cable subassembly 41 includes two signal wires 42 with two non-insulated grounding drain wires 43 outside, and a conductive layer 44 surrounding the signal wires 42 and the non-insulated grounding drain wires 43. The conductive layer 44 electrically contacts with the non-insulated grounding drain wires 43 so as to shield the signal wires 42 from noises. The two cable subassemblies 41 are arranged in a same plane. However, such a kind of electrical cable needs considerable non-insulated grounding drain wires, which not only increases the manufacturing cost but also complicates the manufacturing process.

Hence, an improved grounded electrical cable is required to overcome the disadvantages of the prior art.

BRIEF SUMMARY OF THE INVENTION

The object of the present invention is to provide an electrical cable having an improved grounding means which reduces the cost of the electrical cable and simplifies the manufacturing process thereof.

An electrical cable in accordance with the present invention, which is adapted for connecting with an electrical connector, comprises a pair of cable assemblies. Each cable subassembly has two signal wires for transmitting data and a metal braid wrapping round the two signal wires. Each signal wire comprises a signal conductor and an insulating layer outside. An outer jacket surrounds the tow cable subassemblies. A grounding sleeve, which is made of a metal sheet, comprises two recess portions and a pair of ears extending from opposite ends thereof. Three grounding pins project from the grounding sleeve at intervals for being soldered to corresponding grounding terminals of the electrical connector.

Other objects, advantages and novel features of the invention will become more apparent from the following detailed description of the present embodiment when taken in conjunction with the accompanying drawings.

DETAILED DESCRIPTION OF THE INVENTION

Figure 1:
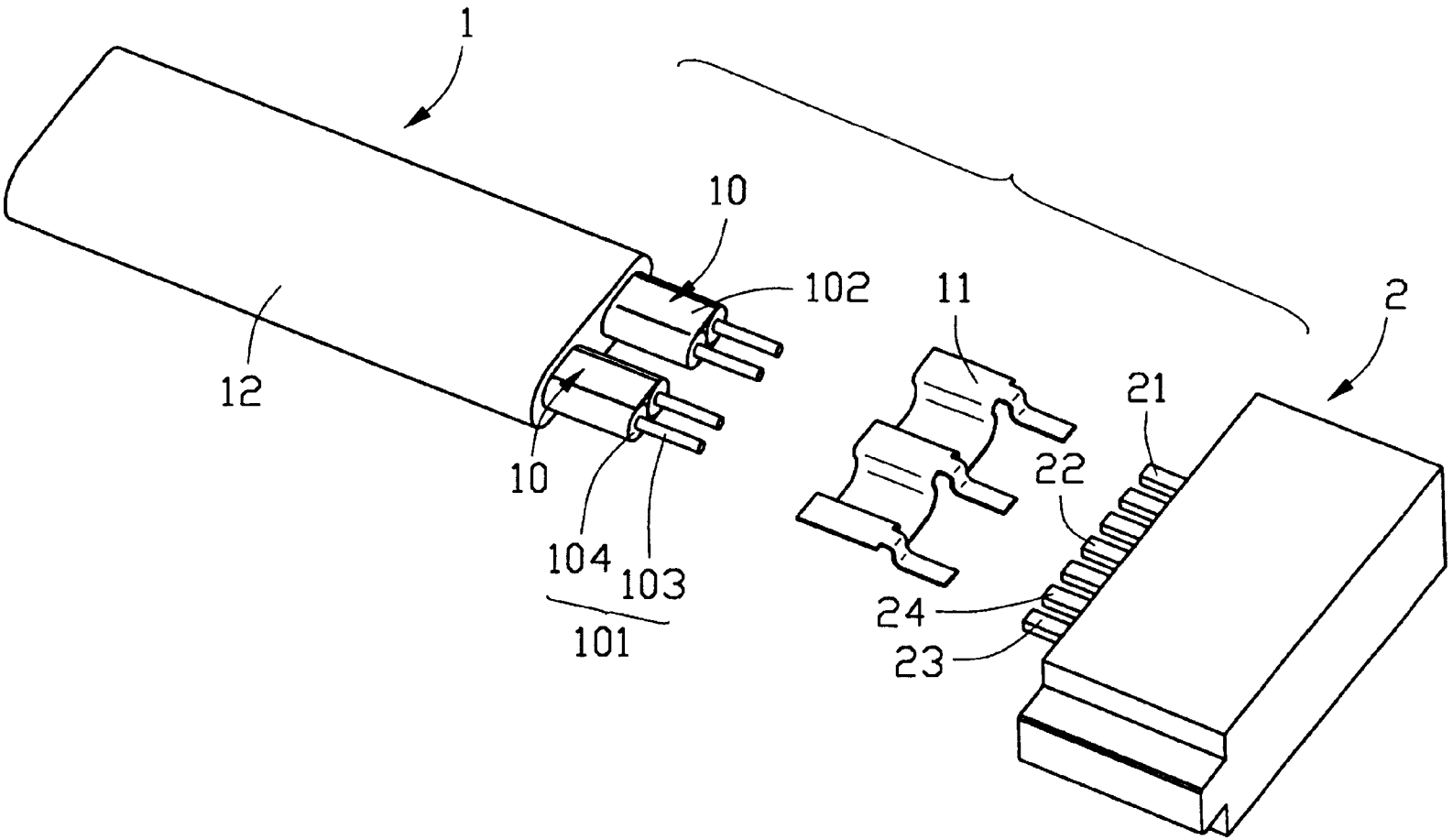
FIG. 1 is an exploded, perspective view of an electrical cable in accordance with the present invention, adapted for connecting to an electrical connector.

Referring to FIG. 1, an electrical cable 1 used with a Serial Advanced Technology Attachment (ATA) connector 2 for signal transmission is shown. The electrical cable 1 comprises two cable subassemblies 10 each including a pair of signal wires 101 with a metal braid 102 surrounding thereabout, and an outer jacket 12 covering the two cable subassemblies 10. A grounding sleeve 11 is attached to the electrical cable 1 for electrically contacting with the metal braid 102 of each cable subassembly 10 to provide a grounding circuit.

Each signal wire 101 comprises a signal conductor 103 for transmitting data and an insulating layer 104 wrapping up the signal conductor 103. The two cable subassemblies 10 are arranged side by side and spaced from each other a predeterminate distance. Front portion of each cable subassembly 10 is exposed to the outside for an electrical connection between the grounding sleeve 11 and the metal braid 102. Distal ends of the signal conductors 103 extend externally from the front portions of the cable subassemblies 10 to be soldered with corresponding terminals of the Serial ATA connector 2.

Figure 2:
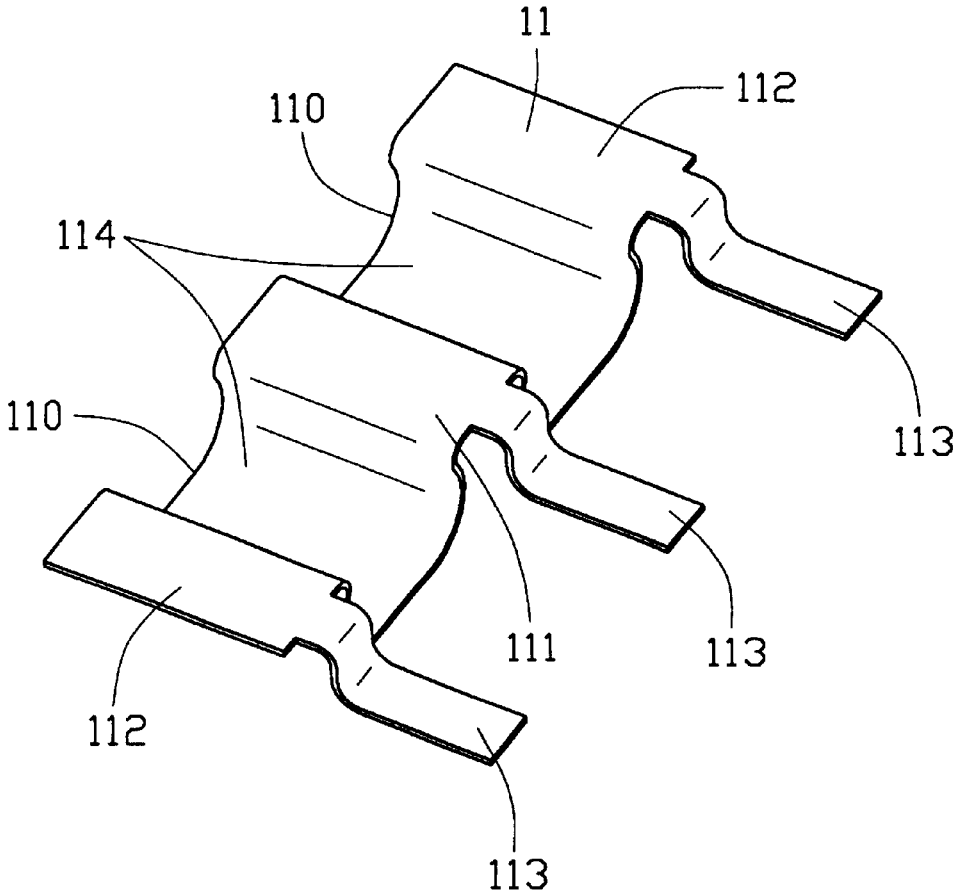
FIG. 2 is a perspective view of a grounding sleeve of the electrical cable shown in FIG. 1.
Figure 3:
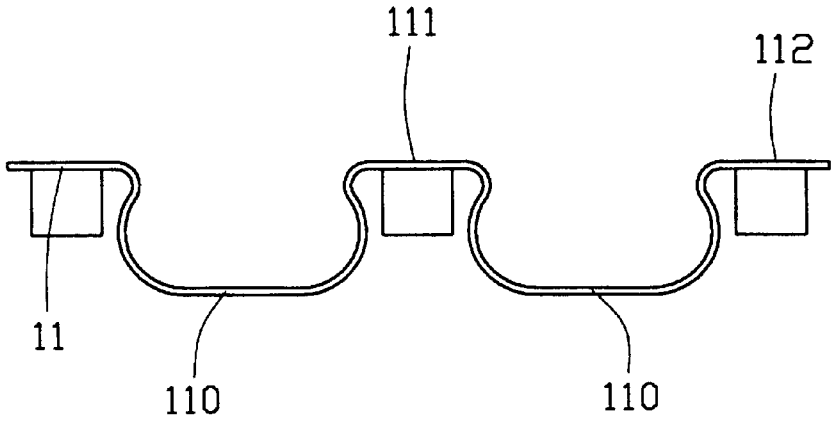
FIG. 3 is a perspective view of the electrical cable with the grounding sleeve assembled thereto.

Referring to FIGS. 2 and 3, the grounding sleeve 11, which is made of a metal sheet, is shaped as wavilness. A pair of recess portions 110 are defined parallely in the grounding sleeve 11 and a middle portion 111 is formed therebetween. Each recess portion 110 defines a chamber 114 therein for substantially receiving corresponding cable subassembly 10. Two ears 112 extend horizontally from opposite ends of the grounding sleeve 11. Three grounding pins 113 respectively project forward from edges of the two ears 112 and the middle portion 111 for electrically soldering to corresponding grounding terminals 21, 22, 23 of the Serial ATA connector 2 to achieve a grounding function.

Figure 4:
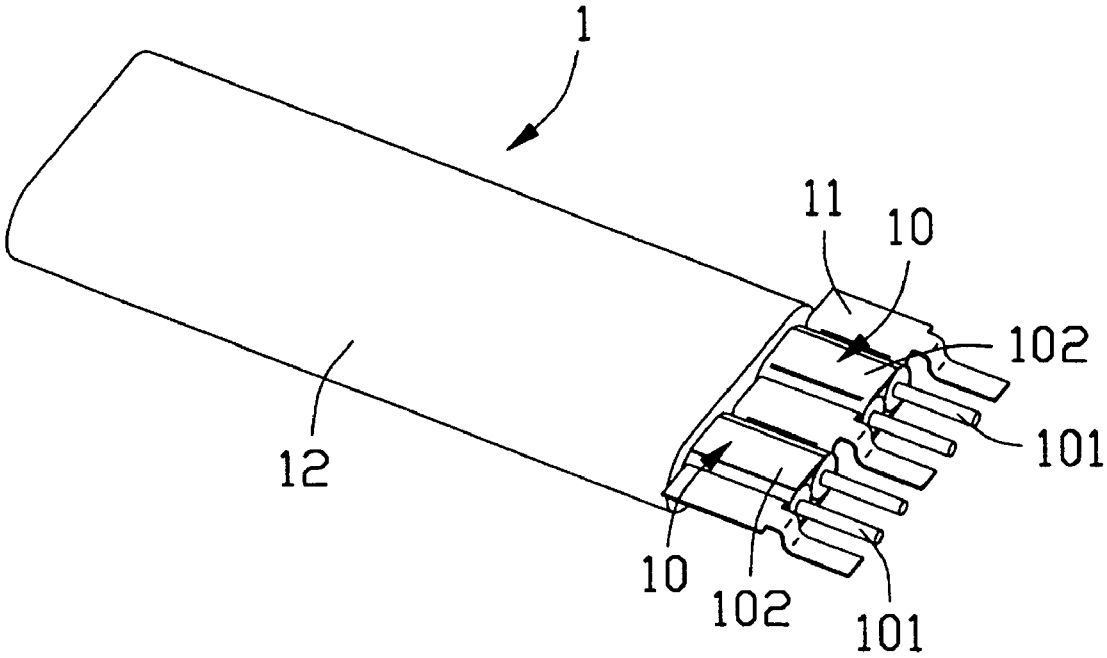
FIG. 4 is a cross-sectional view of a conventional shielded cable.
Figure 5:
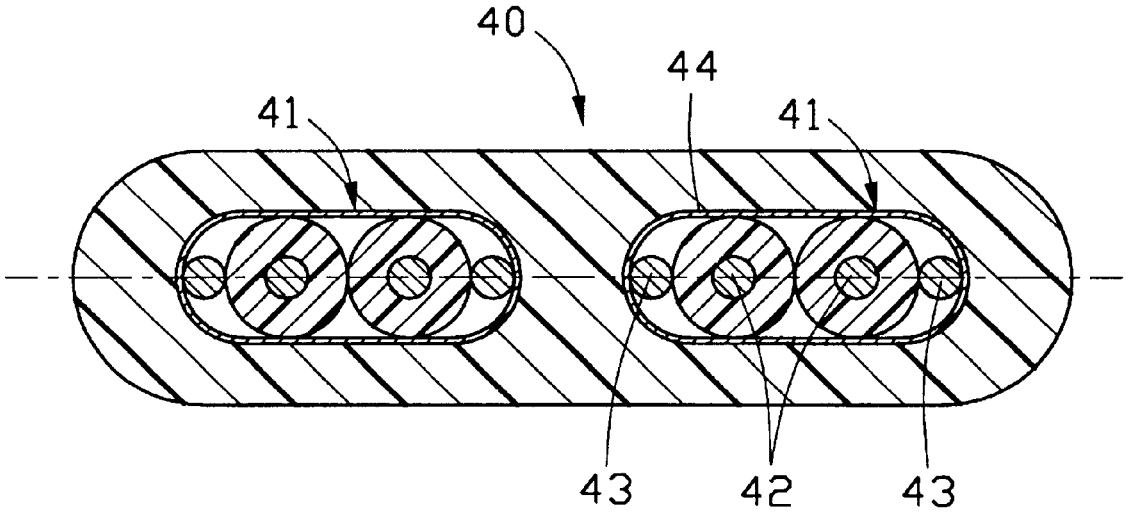
FIG. 5 (PRIOR ART)
FIG. 5 is a cross-sectional view of another conventional shielded cable.

In assembly, as shown in FIG. 4, the cable subassemblies 10 are press fitted into the corresponding chambers 114 of the recess portions 110 of the grounding sleeve 11, respectively, and the metal braids 102 thereof electrically contact with the grounding sleeve 11. The grounding pins 113 of the grounding sleeve 11 and the signal conductors 101 of the cable subassemblies 10 are positioned in a common plane. The distal ends of the signal conductors 103 extend the same distance as the grounding pins 113 of the grounding sleeve 11 extend, and the pitches between the neighbor signal conductors 101 and the grounding pins 113 are average to match the pitch of the terminals of the Serial ATA connector 2. Then, the signal conductors 103 and the three grounding pins 113 are soldered to corresponding signal terminals 24 and the grounding terminals 21, 22, 23 of the Serial ATA connector 2. Thus, a grounding trace is established between the electrical cable 1 and the Serial ATA connector 2. Finally, the outer jacket 12 are insert molded onto the cable subassemblies 10.

Compared with the prior art, the present invention provides the grounding sleeve 11 to the electrical cable 1 instead of grounding drain wires, so that the cost of electrical cable is reduced on one hand, and on the other hand, the manufacturing process and the soldering procedure are simplified.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable adapted for terminating with an electrical connector having signal and grounding terminals, comprising:

a pair of cable subassemblies each having two signal wires and a metal braid wrapping up the two signal wires;

an outer jacket surrounding the pair of cable subassemblies to leave respective front portions of the pair of cable subassemblies exposed to outside; and a grounding sleeve having two recess portions for said respective front portions of the cable subassemblies to be press-fitted therein, and grounding pins for being soldered to corresponding said grounding terminals of the electrical connector, said grounding sleeve further comprising a middle portion formed between said two recess portions and a pair of ears projected horizontally from opposite sides of said two recess portions.

2. The electrical cable as claimed in claim 1, wherein the grounding pins of the grounding sleeve include a middle grounding pin and side grounding pins, which extend forward from edges of the middle portion and the pair of ears respectively.

3. The electrical cable as claimed in claim 2, wherein each signal wire comprises a signal conductor and an insulating layer surrounding the signal conductor, distal ends of the signal conductors extending forward from the front portions of the cable subassemblies for being soldered to said signal terminals of the electrical connector.

4. The electrical cable as claimed in claim 3, wherein the distal ends of said signal conductors extend the same distance as and parallel to the grounding pins, pitches between neighboring said signal conductors and grounding pins being equal to pitch of the signal and grounding terminals of the electrical connector.

5. The electrical cable as claimed in claim 1, wherein the recess portions of the grounding sleeve are shaped to substantially receive the cable subassemblies.

6. An electrical connector assembly comprising:

an electrical connector having a plurality of grounding terminals and signal terminals; and an electrical cable adapted for terminating with the electrical connector, comprising:

a plurality of cable subassemblies each having at least two signal wires and a metal braid surrounding the signal wires, each of said signal wires comprising a signal conductor and an: insulating layer surrounding the signal conductor, distal ends of said signal conductors extending outside the insulating layers and forward from front portions of said cable subassemblies for being soldered to corresponding said signal terminals of said electrical connector;

an outer jacket insert molding on the cable subassemblies to leave said front portions of the plurality of cable subassemblies exposed to outside;

a grounding sleeve including a plurality of recess portions for receiving said front portions of the cable subassemblies, a plurality of connecting portions for connecting the recess portions, and a plurality of grounding pins extending forward from edges of the connecting portions for being soldered to corresponding said grounding terminals of the electrical connector; wherein each recess portion of the grounding sleeve defines a chamber therein for fixedly receiving the corresponding cable subassemblies, and said distal ends of the signal conductors and the grounding pins are positioned in a common plane, pitches between neighboring said signal conductors and grounding pin matching pitch of the signal and grounding terminals of the electrical connector.

7. An electrical connector assembly comprising:

an electrical connector having a plurality of alternatively arranged and horizontally aligned signal and grounding terminals therein;

a flat type electrical cable connected to said connector, said cable comprising:

a plurality of cable subassemblies side by side extending along a front-to-back direction of said connector, each of said subassemblies including a pair of juxtaposed signal wires and a metal braid surrounding said pair of signal wires;

an outer insulative jacket enclosing said subassemblies except front portions thereof;

a grounding sleeve connected to the front portions of said subassemblies, said grounding sleeve engaging the braid of each of said subassemblies and defining a plurality of grounding pins along with the exposed signal wires commonly extending forwardly to be respectively mechanically and electrically connected to the corresponding signal and grounding terminals of the electrical connector which are generally aligned with the corresponding signal wires and grounding pins in said front-to-back direction, respectively;

wherein the pair of signal wires of each of said subassemblies are positioned between every two adjacent said grounding pins.

8. The assembly as claimed in claim 7, wherein said grounding sleeve defines a plurality of recess portions corresponding to said subassemblies so as to supportably retain the corresponding subassemblies therein, respectively.

* * * * *